United States Patent [19]

Wahlers et al.

[11] 4,065,743

[45] Dec. 27, 1977

[54] RESISTOR MATERIAL, RESISTOR MADE THEREFROM AND METHOD OF MAKING THE SAME

[75] Inventors: Richard L. Wahlers, Churchville; Kenneth M. Merz, Gladwyne, both of Pa.

[73] Assignee: TRW, Inc., Cleveland, Ohio

[21] Appl. No.: 560,785

[22] Filed: Mar. 21, 1975

[51] Int. Cl.[2] ..... H01C 1/012

[52] U.S. Cl. ..... 338/308; 29/620; 106/47 R; 252/518; 427/102; 427/123; 427/126

[58] Field of Search ..... 338/308, 66; 428/432, 428/426; 29/610, 620; 106/46, 47 R; 252/518; 427/101, 376, 377, 383, 126

[56] References Cited

U.S. PATENT DOCUMENTS

| | | | |
|---|---|---|---|
| 2,564,706 | 8/1951 | Mochel | 219/19 |
| 2,564,707 | 8/1951 | Mochel | 117/54 |
| 2,564,708 | 8/1951 | Mochel | 88/109 |
| 2,564,709 | 8/1951 | Mochel | 201/73 |
| 3,019,137 | 1/1962 | Hanlet et al. | 117/212 |
| 3,914,514 | 10/1975 | MacKenzie | 427/101 |
| 3,915,721 | 10/1975 | Kamigaito et al. | 252/518 |

FOREIGN PATENT DOCUMENTS

| | | |
|---|---|---|
| 857,400 | 12/1960 | United Kingdom. |
| 982,600 | 2/1965 | United Kingdom. |
| 1,031,651 | 6/1966 | United Kingdom. |

OTHER PUBLICATIONS

J. Dearden, *High Value High Voltage Resistors*, "Electronic Components," Mar. 1967, pp. 259–262.

D. B. Binns, *Conducting Glazes*, "Trans. Brit. Ceram. Soc.," Jan. 1974, 73, pp. 7–17.

D. G. Powell, *Semiconducting Glazes for High Voltage Insulators*, "Am. Ceram. Soc. Bull.," 52(8) 1973, pp. 600–603.

M. K. Basu and R. V. Lele, *Effect of Reducing Atmosphere of $SnO_2$–$Sb_2O_5$ -Based Semiconducting Glaze*, "Am. Ceram. Soc. Bull.," 53(6), 1974, pp. 488–489.

Burkett, R. H. W., *Tin Oxide Resistors*, "Jour. Brit. I.R.E.," Apr. 1961, pp. 301–304.

R. W. Gress, J. A. Murphy, and A. T. Talwalkar, *Characteristics of Antimony-Doped Tin* (IV) *Oxide Films* "Proceedings of 1968 Electronic Components Conference."

*Primary Examiner*—C. L. Albritton

*Attorney, Agent, or Firm*—Jacob Trachtman

[57] ABSTRACT

A vitreous enamel resistor material comprising a mixture of a vitreous glass frit and fine particles of a mixture of tin oxide ($SnO_2$) and tantalum oxide ($Ta_2O_5$). An electrical resistor is made from the resistor material by applying the material to a substrate and firing the coated substrate to a temperature at which the glass melts. The oxide mixture may be heat treated prior to mixing with the glass frit. Upon cooling, the substrate has on the surface thereof a film of the glass having the particles of the oxides embedded therein and dispersed throughout. The resistor material provides a resistor having a high resistivity and a low temperature coefficient of resistance.

28 Claims, 2 Drawing Figures

RESISTOR MATERIAL, RESISTOR MADE THEREFROM AND METHOD OF MAKING THE SAME

The present invention relates to a resistor material, resistors made from the material, and a method of making the material. More particularly, the present invention relates to a vitreous enamel resistor material which provides a resistor having a high resistivity and low temperature coefficient of resistance, and which is made from relatively inexpensive materials.

A type of electrical resistor material which has recently come into commercial use is a vitreous enamel resistor material which comprises a mixture of a glass frit and finely divided particles of an electrical conductive material. The vitreous enamel resistor material is coated on the surface of a substrate of an electrical insulating material, usually a ceramic, and fired to melt the glass frit. When cooled, there is provided a film of glass having the conductive particles dispersed therein.

Since there are requirements for electrical resistors having a wide range of resistance values, it is desirable to have vitreous enamel resistor materials with respective properties which will allow the making of resistors over a wide range of resistance values. However, a problem has arisen with regard to providing a vitreous enamel resistor material which will provide resistors having a high resistivity and which are also relatively stable with changes in temperature, i.e., has a low temperature coefficient of resistance. The resistor materials which provide both high resistivities and low temperature coefficients of resistance generally utilize the noble metals as the conductive particles and are therefore relatively expensive. As described in the article by J. Dearden entitled "High Value, High Voltage Resistors," ELECTRONIC COMPONENTS, March 1967, pages 259–261, a vitreous enamel resistor material using tin oxide doped with antimony has been found to provide high resistivities and is of a less expensive material. However, this material has a high negative temperature coefficient of resistance.

It is therefore an object of the present invention to provide a novel resistor material and resistor made therefrom.

It is another object of the present invention to provide a novel vitreous enamel resistor material and a resistor made therefrom.

It is a still further object of the present invention to provide a vitreous enamel resistor material which provides a resistor having a high resistivity and a relatively low temperature coefficient of resistance.

It is another object of the present invention to provide a vitreous enamel resistor material which provides a resistor having a high resistivity and a relatively low temperature coefficient of resistance and which is of a relatively inexpensive material.

Other objects will appear hereinafter.

These objects are achieved by a resistor material comprising a mixture of a glass frit and finely divided particles of tin oxide and tantalum oxide, and which mixture may be heat treated prior to mixing with the glass frit.

The invention accordingly comprises a composition of matter possessing the characteristics, properties, and the relation of components which are exemplified in the compositions hereinafter described, and the scope of the invention is indicated in the claims.

For a fuller understanding of the nature and objects of the invention, reference should be had to the following detailed description taken in connection with the accompanying drawing in which.

Figure 1:
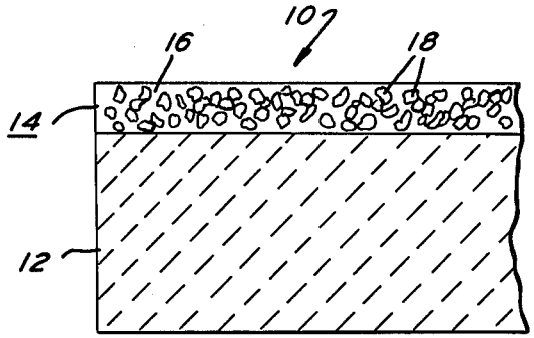
FIG. 1 is a sectional view of a portion of a resistor made with the resistor material of the present invention.

In general the vitreous enamel resistor material of the present invention comprises a mixture of a vitreous glass frit and fine particles of a conductive phase which is a mixture of tin oxide ($SnO_2$) and tantalum oxide ($Ta_2O_5$). The glass frit is present in the resistor material in the amount of 30 to 70% by volume, and preferably in the amount of 40 to 60% by volume. In the conductive phase, the tantalum oxide is present in the amount of 0.5 to 50% by weight of the conductive phase.

The glass frit used may be any of the well known compositions used for making vitreous enamel resistor compositions and which has a melting point below that of the conductive phase. However, it has been found preferable to use a borosilicate frit, and particularly an alkaline earth borosilicate frit, such as a barium or calcium borosilicate frit. The preparation of such frits is well known and consists, for example, of melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

The resistor material of the present invention may be made by thoroughly mixing together the glass frit, tin oxide particles and tantalum oxide particles in the appropriate amounts. The mixing is preferably carried out by ball milling the ingredients in water or an organic medium, such as butyl carbitol acetate or a mixture of butyl carbitol acetate and toluol. The mixture is then adjusted to the proper viscosity for the desired manner of applying the resistor material to a substrate by either adding or removing the liquid medium of the mixture. For screen stencil application, the liquid may be evaporated and the mixture blended with a screening vehicle such as manufactured by L. Reusche and Company, Newark, N.J.

Another method of making the resistor material which provides for better control of resistivity, particularly for lower resistance values, is to first mix together the tin oxide and the tantalum oxide in the proper proportions. This can be achieved by ball milling the mixture with a liquid vehicle, such as butyl carbitol acetate. The liquid vehicle is evaporated and the remaining powder is then heat treated in a non-oxidizing atmosphere. The products resulting from such heat treatment are then mixed with the glass frit to form the resistor material. These products have been observed to be $SnO_2$, $Ta_2O_5$ and an additional phase thought to be a compound of $SnO_2$ and $Ta_2O_5$. The powder may be heat treated in any one of the following manners:

Heat treatment 1: A boat containing the conductive phase (the tantalum oxide and tin oxide mixture) is placed in a tube furnace and forming gas (95% $N_2$ and 5% $H_2$) is introduced into the furnace so that it flows over the boat. The furnace is heated to 525° C and held at that temperature for a short period of time (up to about 10 minutes). The furnace is then turned off and the boat containing the conductive phase is allowed to cool with the furnace to room temperature. The forming gas atmosphere is maintained until the conductive phase is removed from the furnace.

Heat treatment 2: A boat containing the conductive phase is placed on the belt of a continuous furnace. The boat is fired at a peak temperature of 1000° C over a 1 hour cycle in a nitrogen atmosphere.

Heat treatment 3: Same as heat treatment 1 except that a nitrogen atmosphere is used in the furnace and the furnace is heated to 1100° C and held at this temperature for 4 hours. The heat treated powder is then ball-milled to reduce the particle size to preferably less than 1 micron.

The heat treated powder is then mixed with the appropriate amount of the glass frit in the same manner as previously described.

To make a resistor with the resistor material of the present invention, the resistor material is applied to a uniform thickness on the surface of a substrate. The substrate may be a body of any material which can withstand the firing temperature of the resistor material. The substrate is generally a body of a ceramic, such as glass, porcelain, steatite, barium titanate, alumina, or the like. The resistor material may be applied on the substrate by brushing, dipping, spraying, or screen stencil application. The substrate with the resistor material coating is then fired in a conventional furnace at a temperature at which the glass frit becomes molten. The resistor material is preferably fired in an inert atmosphere, such as argon, helium or nitrogen. The particular firing temperature used depends on the melting temperature of the particular glass frit used. When the substrate and resistor material are cooled, the vitreous enamel hardens to bond the resistance material to the substrate.

As shown in FIG. 1 of the drawing, a resultant resistor of the present invention is generally designated as 10. Resistor 10 comprises a ceramic substrate 12 having a layer 14 of the resistor material of the present invention coated and fired thereon. The resistor material layer 14 comprises the glass 16 containing the finely divided particles 18 of the conductive phase. The conductive phase particles 18 are embedded in and dispersed throughout the glass 16.

The following examples are given to illustrate certain preferred details of the invention, it being understood that the details of the examples are not to be taken as in any way limiting the invention thereto.

EXAMPLE I

A conductive phase of tin oxide and tantalum oxide, in which 15% by weight was the tantalum oxide, was made by mixing together the oxides. The oxides were heat treated by the heat treatment 1, previously described. Several batches of resistor materials were made by mixing the conductive phase with different quantities of a glass frit of a composition of 40% BaO, 20% $B_2O_3$, 25% $SiO_2$, 10% $SnO_2$, 3% $Al_2O_3$ and 2% $Ta_2O_5$. The proportions of the conductive phase and the glass frit in each of the batches is shown in Table I. Each of the mixtures was ball-milled with butyl carbitol acetate to achieve a thorough mixture. The butyl carbitol acetate was evaporated and the mixture was blended with a squeegee medium manufactured by L. Reusche and Company, Newark, N.J. to form the resistor compositions.

Resistors were made with each of the resultant resistor compositions by screen stenciling the compositions on ceramic plates. The ceramic plates with the resistor material thereon were dried at 150° C for 15 minutes and then placed in a furnace at 400° C for 1 hour to drive off the screening vehicle. The resistors were then fired in a tunnel furnace having a nitrogen atmosphere at the temperatures shown on Table I, over a 30 minute cycle. The resistivity and temperature coefficient of resistance for the resultant resistors are shown in Table I.

TABLE I

| Glass Frit % by volume | Conductive Phase % by volume | Firing Temperature ° C | Resistivity ohm/square | Temp. Coef. of Resistance ppm/° C |
|---|---|---|---|---|
| 30 | 70 | 1000 | 10 K | 132 |
| 50 | 50 | 1000 | 12 K | 38 |
| 65 | 35 | 1000 | 213 K | −868 |
| 70 | 30 | 850 | 840 K | −907 |

EXAMPLE II

A conductive phase was made in the manner described in EXAMPLE I except that 0.5% by weight of tantalum oxide was mixed with the tin oxide. The conductive phase powder was mixed with a glass frit of the composition 42% BaO, 20% $B_2O_3$ and 38% $SiO_2$, with the amount of the conductive phase being 50% by volume. The mixture was made into a resistor material in the manner described in EXAMPLE I. The resistor material was made into a resistor in the manner described in EXAMPLE I with the resistor being fired at 1100° C. The resultant resistor had a sheet resistivity of 2 kilo-ohms/square and a temperature coefficient of resistance of −6 ppm/° C.

EXAMPLE III

A conductive phase was made by using heat treatment 2 on a mixture of 5% by weight of tantalum oxide and 95% by weight tin oxide. A resistor material was made in the manner described in EXAMPLE I by mixing the powder with a glass frit of the composition used in EXAMPLE II with 45% by volume being the conductive phase and 55% by volume being the glass frit. Resistors were made by screen stenciling the resistor composition onto ceramic plates. The coated plates were dried at 150° C for 15 minutes. The ceramic plates were then passed through a tunnel furnace having a nitrogen atmosphere and a peak temperature of 350° C over a ½ hour cycle. The coated ceramic plates were then fired in a tunnel furnace containing a nitrogen atmosphere over a 30 minute cycle. One of the coated ceramic plates was fired at a peak temperature of 900° C and another at 1000° C. The resultant resistor which was fired at 900° C has a sheet resistivity of 115 K ohms/square and a temperature coefficient of resistance of −99 ppm/° C. The resultant resistor which was fired at 1000° C had a sheet resistivity of 77 K ohms/square and a temperature coefficient of resistance of zero.

EXAMPLE IV

A conductive phase was made in the manner described in EXAMPLE III except that the conductive phase included 15% by weight of the tantalum oxide. A resistor material was made with the conductive phase as described in EXAMPLE III and resistors were made from the resistor material in the manner described in EXAMPLE III. The resultant resistors which were fired at 900° C had an average sheet resistivity of 230 K ohms/square and a temperature coefficient of resistance of −97 ppm/° C. The resultant resistors which were fired at 1000° C had an average sheet resistivity of 220 K ohms/square and a temperature coefficient of resistance of −100 ppm/° C.

EXAMPLE V

A conductive phase was made in the manner described in EXAMPLE III except that the conductive phase included 50% by weight of the tantalum oxide. A resistor material was made with the conductive phase as described in EXAMPLE III except that it included 50% by volume of the conductive phase and 50% by volume of the glass frit. A resistor was made from the resistor material in the manner described in EXAMPLE III except that the resistor was fired at 950° C. The resultant resistor had a sheet resistivity of 3 megaohms/square and a temperature coefficient of resistance of −570 ppm/° C.

EXAMPLE VI

A conductive phase was made by mixing together 15% by weight of tantalum oxide and 85% by weight of tin oxide. The conductive phase without any heat treatment was made into a resistor material by mixing together 50% by volume of the conductive phase and 50% by volume of a glass frit of the same composition used in EXAMPLE III. The mixture was blended with the squeegee medium and screen stenciled onto ceramic plates to make resistors. The resistors were dried at 150° C for 15 minutes and then passed through a tunnel furnace containing an air atmosphere and having a peak temperature of 350° C. A resistor fired in a tunnel furnace having a nitrogen atmosphere and a peak temperature of 1100° C over a ½ hour cycle had a sheet resistivity of 19 K ohms/square and a temperature coefficient of resistance of 88 ppm/° C.

EXAMPLE VII

A conductive phase was made in the manner described in EXAMPLE I. A resistor material was made with this conductive phase in the manner described in EXAMPLE VI. The resistor material was made into resistors in the manner described in EXAMPLE VI except that the firing temperature was 1000° C. The resultant resistors had an average sheet resistivity of 37 K ohms/square and a temperature coefficient of resistance of 46 ppm/° C.

EXAMPLE VIII

A conductive phase was made by mixing 15% by weight of tantalum oxide and 85% by weight of tin oxide and subjecting the mixture to heat treatment 3. The conductive phase was ball-milled to reduce its particle size. The conductive phase powder was made into a resistor material in the manner described in EXAMPLE VI but with the material including 45% by volume of the conductive phase and 55% by volume of the glass frit. The resistor material was made into resistors as described in EXAMPLE VI except that the resistors were fired at a temperature of 1000° C. A typical resistor had a sheet resistivity of 93 K ohms/square and a temperature coefficient of resistance of −337 ppm/° C.

EXAMPLE IX

A conductive phase was made in the manner described in EXAMPLE I. A resistor material was made by mixing together 50% by volume of the conductive phase and 50% by volume of a glass frit of the composition 44% $SiO_2$, 30% $B_2O_3$, 14% $Al_2O_3$, 10% MgO and 2% CaO. The mixture was blended with a squeegee medium. The resistor material was made into resistors in the manner described in EXAMPLE I with the furnace being at a peak temperature of 1150° C. A typical resistor had a sheet resistivity of 5 M ohms/square and a temperature coefficient of resistance of −465 ppm/° C.

From the above Examples there can be seen the effects on the electrical characteristics of the resistor of the present invention of variations in the composition of the resistor material and the method of making the resistor material. Example I shows the effects of varying the ratio of the conductive phase and the glass frit. EXAMPLES II, III, IV and V show the effect of varying the ratio of tantalum oxide and tin oxide in the conductive phase. EXAMPLE IV, VI, VII and VIII show the effect of heat treatment. EXAMPLE I, VII and IX show the effects of varying the composition of the glass frit. As can be seen from these Examples, the resistor material of the present invention can provide resistors having a high resistivity and a relatively low temperature coefficient of resistance.

Figure 2:
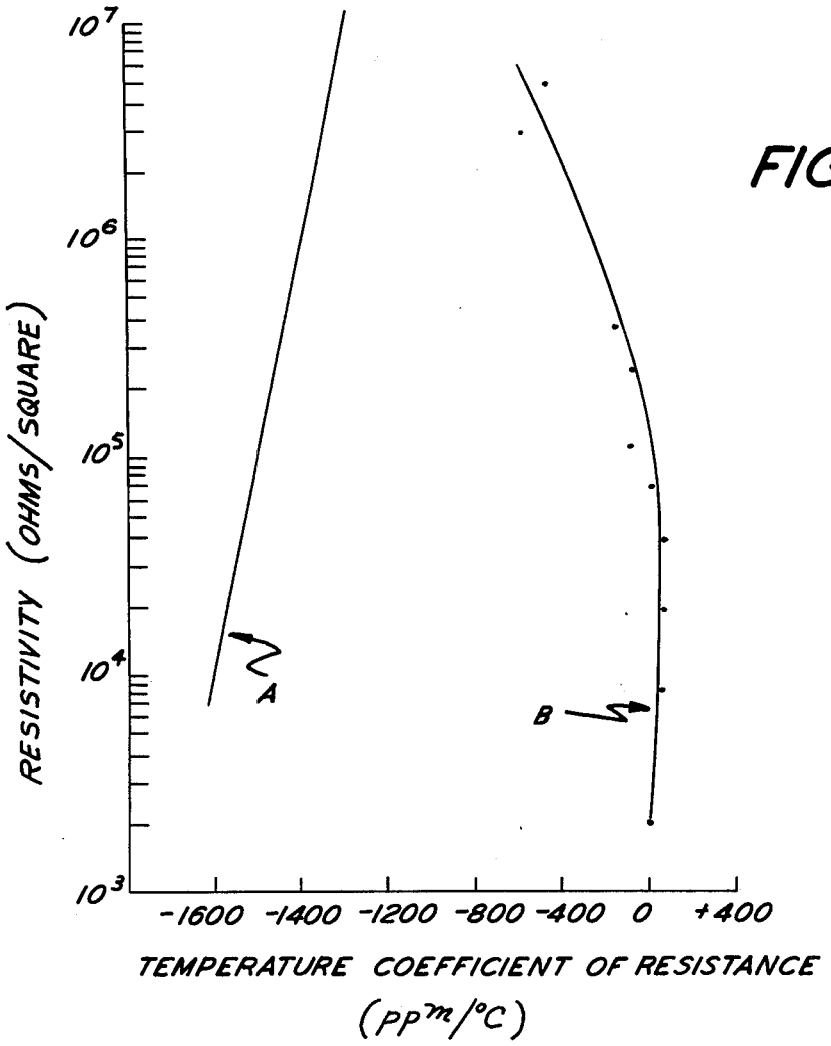
FIG. 2 is a graph comparing the temperature coefficients of resistance of the resistor material of the present invention with those of a prior art resistor material.

In the graph of FIG. 2, line B shows the temperature coefficient of resistance of resistors of various resistivities made with the resistor material of the present invention. Line A shows the temperature coefficient of resistance of various resistivities for a vitreous enamel resistor in which the conductive phase of the resistor material is tin oxide and antimony oxide. This data was taken from the article by J. Dearden previously referred to. As can be seen from FIG. 2, the addition of either antimony oxide or tantalum oxide to the tin oxide in the conductive phase of the resistor material will provide resistors having a high resistivity. However, whereas the addition of antimony oxide to the tin oxide produces a negative temperature coefficient of resistance so that the resultant resistors have a high negative temperature coefficient of resistance, the addition of tantalum oxide to the tin oxide in accordance with the present invention makes the temperature coefficient of resistance more positive so that the resultant resistors have a lower temperature coefficient of resistance, i.e., a temperature coefficient of resistance which is closer to zero. Thus, the resistance material of the present invention provides a resistor which has a high resistivity and is relatively stable with regard to changes in temperature. Also, the resistor material of the present invention is made of materials which are relatively inexpensive.

It will thus be seen that the objects set forth above, among those made apparent from the preceding description, are efficiently attained and, since certain changes may be made in the above composition of matter without departing from the scope of the invention, it is intended that all matter contained in the above description shall be interpreted as illustrative and not in a limiting sense.

What is claimed is:

1. A vitreous enamel resistor material comprising a mixture of a glass frit and particles of a conductive phase, said conductive phase being selected from the group consisting essentially of (1) a mixture of tin oxide and tantalum oxide, and (2) a mixture of tin oxide, tantalum oxide and the products resulting from heat treatment of said mixture of tin oxide and tantalum oxide.

2. A vitreous enamel resistor material in accordance with claim 1 in which the glass frit is present in the amount of 30 to 70% by volume.

3. A vitreous enamel resistor material in accordance with claim 2 in which the glass frit is present in the amount of 40 to 60% by volume.

4. A vitreous enamel resistor material in accordance with claim 2 in which the conductive phase includes 0.5 to 50% by weight of the tantalum oxide.

5. A vitreous enamel resistor material in accordance with claim 4 in which the conductive phase comprises a mixture of the tin oxide and the tantalum oxide.

6. A vitreous enamel resistor material in accordance with claim 4 in which the conductive phase includes the products resulting from a heat treatment of a mixture of tin oxide and the tantalum oxide.

7. A vitreous enamel resistor material in accordance with claim 4 in which the glass frit is a borosilicate glass.

8. A vitreous enamel resistor material in accordance with claim 7 in which the glass frit is an alkaline earth borosilicate glass.

9. An electrical resistor comprising a ceramic substrate and a layer of a resistor material on a surface of said substrate, said resistor material comprising particles of a conductive phase selected from the group consisting essentially of (1) a mixture of tin oxide and tantalum oxide, and (2) a mixture of tin oxide, tantalum oxide and the products resulting from heat treatment of said mixture of tin oxide and tantalum oxide embedded in and dispersed throughout a glass.

10. An electrical resistor in accordance with claim 9 in which the resistor material contains 30 to 70% by volume of the glass.

11. An electrical resistor in accordance with claim 10 in which the resistor material contains 40 to 60% by volume of the glass.

12. An electrical resistor in accordance with claim 10 in which the conductive phase of the resistor material contains 0.5 to 50% by weight of tantalum oxide.

13. An electrical resistor in accordance with claim 12 in which the conductive phase of the resistor material is a mixture of the tin oxide and the tantalum oxide.

14. An electrical resistor in accordance with claim 12 in which the conductive phase of the resistor material includes the products resulting from a heat treatment of a mixture of tin oxide and the tantalum oxide.

15. An electrical resistor in accordance with claim 12 in which the glass is a borosilicate glass.

16. An electrical resistor in accordance with claim 15 in which the glass is an alkaline earth borosilicate glass.

17. A method of making an electrical resistor comprising the steps of mixing together a glass frit and fine particles of a conductive phase being selected from the group consisting essentially of (1) a mixture of tin oxide and tantalum oxide, and (2) a mixture of tin oxide, tantalum oxide and the products resulting from heat treatment of said mixture of tin oxide an tantalum oxide, applying said mixture to a surface of a substrate, and firing said coated substrate in a substantially inert atmosphere to the melting temperature of the glass frit.

18. The method in accordance with claim 17 in which prior to mixing the conductive phase with the glass frit, the tin oxide and tantalum oxide are mixed together, then heat treated, and then formed into the fine particles of the conductive phase.

19. The method in accordance with claim 18 in which the conductive phase is heat treated by heating to about 525° C in an atmosphere of forming gas for up to about 10 minutes, and then is cooled while retained in the forming gas atmosphere.

20. The method in accordance with claim 18 in which the conductive phase is heat treated in a furnace having a nitrogen atmosphere and a peak temperature of about 1000° C for about 1 hour.

21. The method in accordance with claim 18 in which the conductive phase is heat treated by heating in a nitrogen atmosphere at a temperature of about 1100° C for up to 4 hours.

22. The method in accordance with claim 20 in which the conductive phase is heat treated by passing the conductive phase through a furnace having a nitrogen atmosphere and a peak temperature of about 1000° C over a 1 hour cycle.

23. An electrical resistor of the vitreous glaze type made by mixing together a glass frit and fine particles of a conductive phase being selected from the group consisting essentially of (1) a mixture of tin oxide and tantalum oxide, and (2) a mixture of tin oxide, tantalum oxide and the products resulting from heat treatment of said mixture of tin oxide and tantalum oxide, applying said mixture to a surface of a substrate, and firing said coated substrate in a substantially inert atmosphere to the melting temperature of the glass frit.

24. An electrical resistor made in accordance with claim 23 in which prior to mixing the conductive phase with the glass frit, the tin oxide and tantalum oxide are mixed together, then heat treated, and then formed into the fine particles of the conductive phase.

25. An electrical resistor made in accordance with claim 24 in which the conductive phase is heat treated by heating to about 525° C in an atmosphere of forming gas for up to about 10 minutes, and then is cooled while retained in the forming gas atmosphere.

26. An electrical resistor made in accordance with claim 24 in which the conductive phase is heat treated in a furnace having a nitrogen atmosphere and a peak temperature of about 1000° C for about 1 hour.

27. An electrical resistor made in accordance with claim 24 in which the conductive phase is heat treated by heating in a nitrogen atmosphere at a temperature of about 1100° C for up to 4 hours.

28. An electrical resistor made in accordance with claim 26 in which the conductive phase is heat treated by passing the conductive phase through a furnace having a nitrogen atmosphere and a peak temperature of about 1000° C over a 1 hour cycle.

* * * * *